US009765771B2

(12) United States Patent
Manara et al.

(10) Patent No.: US 9,765,771 B2
(45) Date of Patent: Sep. 19, 2017

(54) POSITIVE DISPLACEMENT MACHINE WITH A GLAND FOR DOUBLE PACKING SEALS

(71) Applicant: Peroni Pompe S.p.A., Corsico (IT)

(72) Inventors: Luciano Manara, Milan (IT); Alberto Randi, Bareggio (IT); Giorgio Vinciguerra, Buccinasco (IT)

(73) Assignee: PERONI POMPE S.P.A., Corsico (IT)

( * ) Notice: Subject to any disclaimer, the term of this patent is extended or adjusted under 35 U.S.C. 154(b) by 260 days.

(21) Appl. No.: 14/410,651

(22) PCT Filed: Jun. 19, 2013

(86) PCT No.: PCT/EP2013/062709
§ 371 (c)(1),
(2) Date: Dec. 23, 2014

(87) PCT Pub. No.: WO2014/001169
PCT Pub. Date: Jan. 3, 2014

(65) Prior Publication Data

US 2015/0219094 A1 Aug. 6, 2015

(30) Foreign Application Priority Data

Jun. 25, 2012 (EP) ..... 12425116

(51) Int. Cl.
*F01B 9/00* (2006.01)
*F04B 53/02* (2006.01)
*F04B 53/16* (2006.01)

(52) U.S. Cl.
CPC ..... *F04B 53/02* (2013.01); *F04B 53/16* (2013.01)

(58) Field of Classification Search
CPC .... F04B 53/16; F04B 53/164; F15B 15/1471; F15B 15/1442; F15B 15/1461
See application file for complete search history.

(56) References Cited

U.S. PATENT DOCUMENTS

| | | | |
|---|---|---|---|
| 3,815,211 | A | 6/1974 | Acord, IV |
| 4,186,629 | A | 2/1980 | Costes |
| 4,351,512 | A | 9/1982 | Siver |

(Continued)

FOREIGN PATENT DOCUMENTS

| | | |
|---|---|---|
| EP | 1 672 217 A1 | 6/2006 |
| GB | 784708 | 10/1957 |

*Primary Examiner* — Michael Leslie
*Assistant Examiner* — Daniel Collins
(74) *Attorney, Agent, or Firm* — Alan G. Towner, Esq.; Leech Tishman Fuscaldo & Lampl

(57) ABSTRACT

A positive displacement machine comprises a cylinder inside which there are a mobile piston, at least one first and one second insulation chamber containing a respective set of gaskets, at least one first and one second gland each of which is suitable for operating on one of the sets of gaskets, each gland comprising a tubular threaded portion and a ring nut fixedly attached to the tubular threaded portion. A sleeve able to slide with respect to said cylinder has a first end in contact with the first set of gaskets and a second threaded end for receiving in engagement the tubular threaded portion of the second gland, the sleeve being slidingly engaged by the first gland, and at least one of the ring nuts being a cylindrical gear wheel with straight teeth.

20 Claims, 5 Drawing Sheets

(56) References Cited

U.S. PATENT DOCUMENTS

| | | | | |
|---|---|---|---|---|
| 4,914,987 | A * | 4/1990 | Isler | B25B 13/48<br>81/56 |
| 2008/0115630 | A1 * | 5/2008 | Vinciguerra | B25B 13/50<br>81/57.44 |

* cited by examiner

POSITIVE DISPLACEMENT MACHINE WITH A GLAND FOR DOUBLE PACKING SEALS

The present invention refers to a positive displacement machine, that is to say a machine having a working chamber with a variable volume in which energy is yielded to a fluid, with a gland for double packing seals. In particular, the present invention refers to a positive displacement hydraulic machine, like for example a reciprocating pump, equipped with a gland so as to ensure the fluid seal between the working chamber (or cylinder) and the mobile member (or piston).

Glands act between the piston and the cylinder of the positive displacement machine so as to prevent the fluid pressurised by the action of the piston from leaking inside the cylinder.

Glands are usually provided with a tubular threaded portion which is coupled with a threading formed on the inner or outer wall of the cylinder. The glands make contact, at their front part, with a set of gaskets, usually a plurality of packing rings, that are active inside an insulation chamber. By screwing the gland on the cylinder, this compresses the packings that, abutting against a fixed wall of the insulation chamber, deform in the radial direction ensuring the mechanical fluid seal between the cylinder and the piston.

Double packing seals are used when in an intermediate chamber, positioned between the packings, a liquid (usually an inert liquid) called barrier fluid, is made to circulate, so as to dilute a corrosive liquid, to cool a liquid that is too hot, to heat a liquid that would otherwise become solid, or to avoid that the fluid pressurised by the pump even accidentally reaches the outside of the pump. Double packing seals are therefore advantageously used in applications which foresee the moving of fluids that are, corrosive, hot, fluids which crystallise at room temperature, the fluids that are toxic, polluting or in any case not inert.

When double packing seals are used there are two glands, one that is active on the insulation chamber upstream of the intermediate chamber and one that is active on the insulation chamber downstream of the intermediate chamber.

In order to maintain a suitable compression level of the gland on the packing, it is necessary to adjust it by screwing or unscrewing it.

For such a purpose, the gland has an annular portion, called ring nut, which is fixedly connected to the tubular threaded portion, and is fitted around the cylinder thanks to which it is possible to set the gland itself in rotation.

Typically, the adjustment of the ring nut of the gland is carried out at periodic time intervals, or when excessive fluid has been found to be leaking between the piston and the cylinder.

In the case of double packing seals, such an adjustment could concern only one of the glands, for example since the leaking is localised only at a single insulation chamber.

The adjustment can be carried out by a worker who, with a suitable tool, engages the ring nut of one gland at a time rotating it until a suitable compression of the packing has been re-established thus interrupting the leaking of liquid. However, the adjustment operation is very complex and requires the worker to have a lot of experience in order to obtain a satisfactory result.

Moreover, the adjustment by a worker is highly inadvisable when the machine is moving. Indeed, the position of the worker during the adjustment manoeuvres is dangerous, since the worker must act between the elements of the moving machine, and therefore operate in precarious conditions even having to act with considerable locking forces. Moreover, in the case of positive displacement machines which operate on non inert fluids, possible leakage of fluid which could hit the worker could be dangerous for his health, making the presence of workers near the machine during the adjustment of the gland unacceptable.

In order to avoid these drawbacks and to operate safely, the adjustment of the gland nut can be actuated in accordance with the teachings of European patent application EP 1 672 217 to the same Applicant. The mentioned document describes a gland nut that is equipped with recesses obtained at predetermined angular intervals, and a device for the adjustment of the gland nut. The adjustment device comprises an engagement element, which is suitable for engaging with the recesses of the nut ring so as to rotate it by a predetermined angle, and a piston at the end of which the engagement element is hinged. The piston can be actuated so as to carry out a linear translation movement between a first position and a second position so as to rotate the gland nut.

The solution described above has however some drawbacks. In particular, the adjustment device is rarely able to be used in pumps having reinforcement walls arranged between two adjacent cylinders. In this case, the engagement element, in the translation movement between the first and the second position, would stop its stroke against the reinforcement wall since, in the second position, the engagement element should be beyond the wall itself.

It should moreover be noted that the engagement element, in its movement between the two positions, accidentally tends to disengage from the recesses of the nut ring, making the adjustment of the nut ring itself unsafe and unreliable.

Consequently, it is considerably desired to have a positive displacement machine with a gland for double packing seals which makes it possible to adjust the glands safely and reliably.

The purpose of the present invention is to propose a positive displacement machine with a gland for double packing seals that is capable of avoiding the drawbacks mentioned with reference to the prior art.

Such a purpose is achieved with a positive displacement machine with a gland for double packing seals in accordance with one or more of the attached claims.

Further characteristics and advantages of the positive displacement machine with gland for double packing seals according to the present invention shall become clearer from the following description of a preferred embodiment thereof, given as an indication and not for limiting purposes, with reference to the attached figures, in which.

Figure 1:
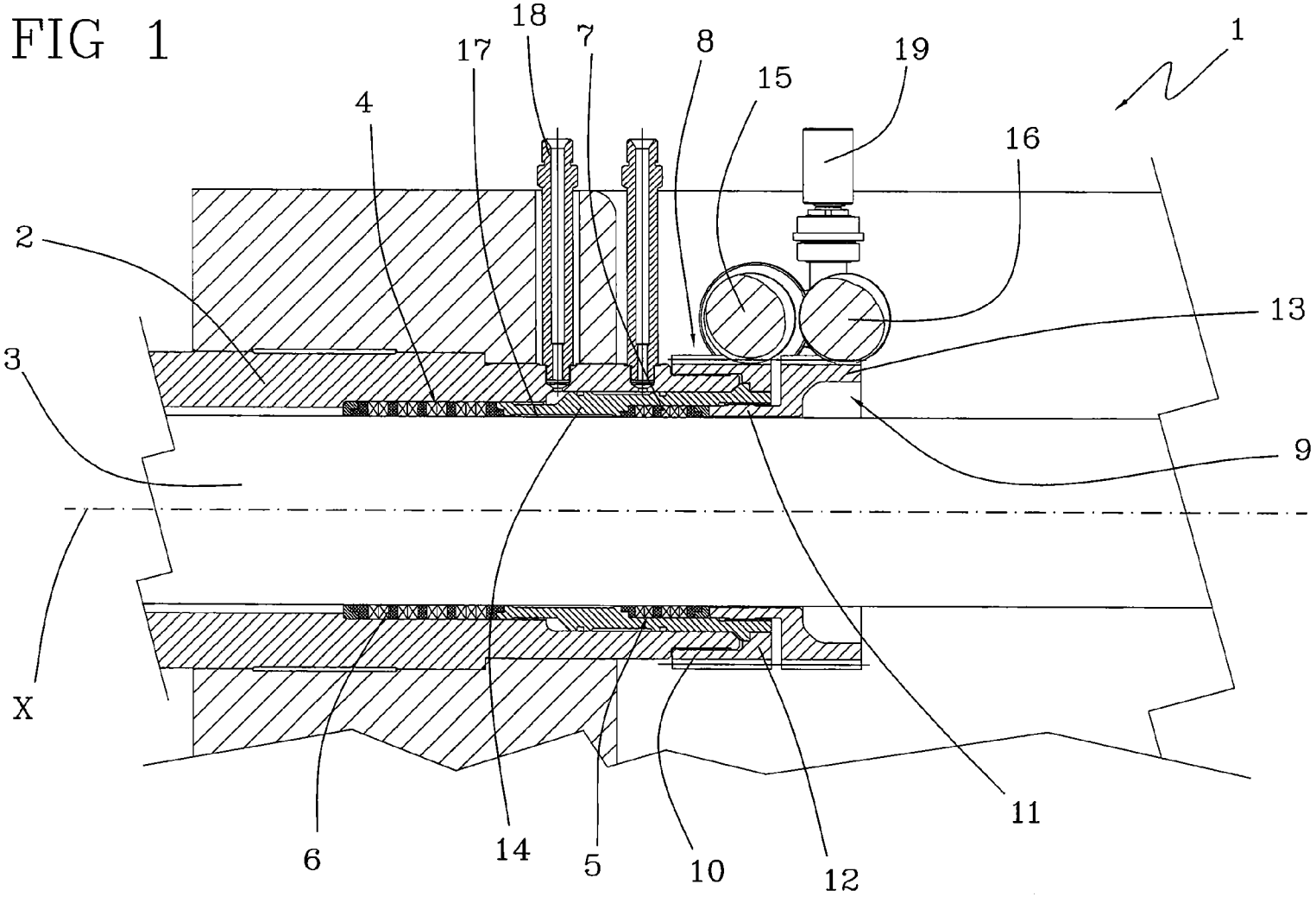
FIG. 1 represents a schematic section view of a positive displacement machine with gland for double packing seals according to the invention.

With reference to the figures, reference numeral 1 wholly indicates a positive displacement machine with gland for double packing seals.

The present description particularly refers to a reciprocating pump as an example of a positive displacement machine, without thereby being limited to the example described.

The machine 1 comprises a cylinder 2 inside which a mobile piston 3 is arranged intended for pressurising a fluid. The cylinder 2 has a rectilinear development axis X that coincides with the direction of movement of the piston 3.

The machine 1 also comprises a first 4 and a second insulation chamber 5 arranged along the cylinder 2 and containing a first 6 and a second 7 set of gaskets, respectively. The insulation chambers 4, 5, have a substantially annular development and are arranged inside the mentioned development axis X of the cylinder. The insulation chambers 4, 5 act between the cylinder 2 and the piston 3 so as to make a fluid seal between them and to avoid leakage of pressurised fluid between the cylinder and the piston. The sets of gaskets are preferably made up of packings made from resilient and compressible material.

A first 8 and a second gland 9 are suitable for operating on the first 6 and on the second set of gaskets 7, so as to compress them and obtain the fluid seal between the cylinder and the piston.

Each gland 8, 9 comprises a tubular threaded portion 10, 11 and a ring nut 12, 13 that is fixedly attached to the tubular threaded portion 10, 11 so as to make it rotate.

A sleeve 14 is slidingly inserted in the cylinder 2 and has a first end 14*a* that is in contact with the first set of gaskets 6 and a second threaded end 14*b*. On such a second threaded end the tubular threaded portion 11 of the second gland 9 is engaged.

The sleeve 14 is moreover slidingly engaged with the first gland 8, so that a translation of the latter determines a translation of the sleeve 14. In such a way, advantageously, the translation of the first gland 8 (which occurs by rotating the respective ring nut 12 as shall become clearer in the rest of the description) determines a compression or a loosening of the first set of gaskets 6, whereas the translation of the second gland 9 (which occurs by rotating the respective ring nut 13 as shall become clearer in the rest of the description) determines a compression or a loosening of the second set of gaskets 7.

Advantageously, at least one of the ring nuts 12, 13 of the first 8 or of the second gland 9 is a cylindrical gear wheel with straight teeth. In the case in which the cylindrical gear wheel is formed on the ring nut 13 of the second gland 9, it is possible for example to rotate the ring nut 12 of the first gland 8 making the sleeve 14 translate (loosening for example the pressure on the first set of gaskets 6) and simultaneously translate the second gland 9 and the second insulation chamber 5 without varying the pressure of the second set of gaskets. This allows a simple and accurate adjustment of the glands in both the insulation chambers 4, 5 making it possible for there to be a perfect calibration of the fluid seals between the cylinder 2 and the piston 3.

In the preferred embodiment of the invention, both the ring nuts 12, 13 are cylindrical gear wheels with straight teeth.

Figure 4:
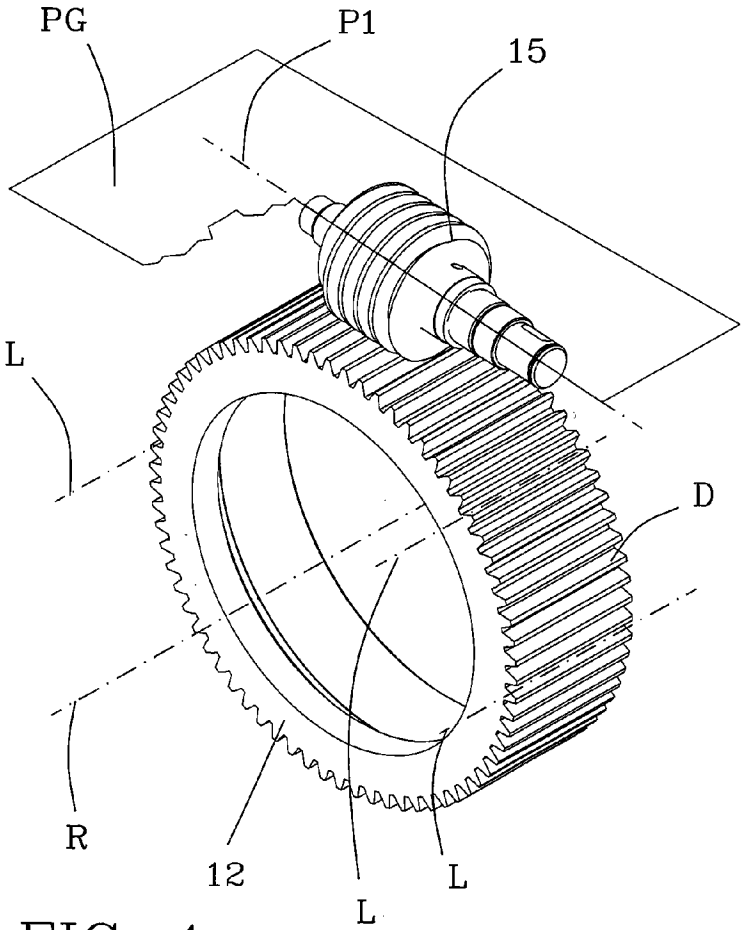
FIG. 4 is a perspective view of a detail of the machine of FIG. 1.

By cylindrical gear wheels with straight teeth, we mean gear wheels with a cylindrical development in which the flank lines L of the teeth D are rectilinear and parallel to one another and are parallel to the rotation axis R of the gear wheel (as illustrated in FIG. 4) In other words, the geometry of the cylindrical gear wheels with straight teeth is obtained through rectilinear translation of the involute profile of the teeth.

The flank lines L of the teeth D are moreover parallel to the development axis X of the cylinder 2.

In order to rotate the ring nuts 12, 13 of the glands, a first 15 and a second cylindrical pinion 16 are foreseen active on the ring nut 12, 13, respectively, of the first 8 and of the second gland 9 so as to transmit movement to them.

The ring nuts 12, 13 can translate along a direction that is parallel to the flank lines L without mechanically interfering with the respective cylindrical pinion 15, 16 even when the pinions are engaged on the respective gear wheels. In the case in which just one of the ring nuts is a cylindrical gear wheel with straight teeth, only such a ring nut would translate as described above without interfering with the respective pinion.

For the sake of clarity, it should be underlined that by the term "translation", in the context of the present invention, we mean a movement which does not have motion components that are inclined with respect to the direction of movement; in other words we mean a movement that does not have rotation components. Similarly, by the term "rotation", in the context of the present invention, we mean a pure rotation movement in which with each revolution each point is back to its original position; in other words we mean a movement which does not have translation components. With the term "rototranslation" we mean, in the context of the present invention, a movement that is made up of a rotation component and a translation component (like for example the movement of a screw).

Preferably, the cylindrical pinions 15, 16 are helical worm screws with involute flanks.

Figure 5:
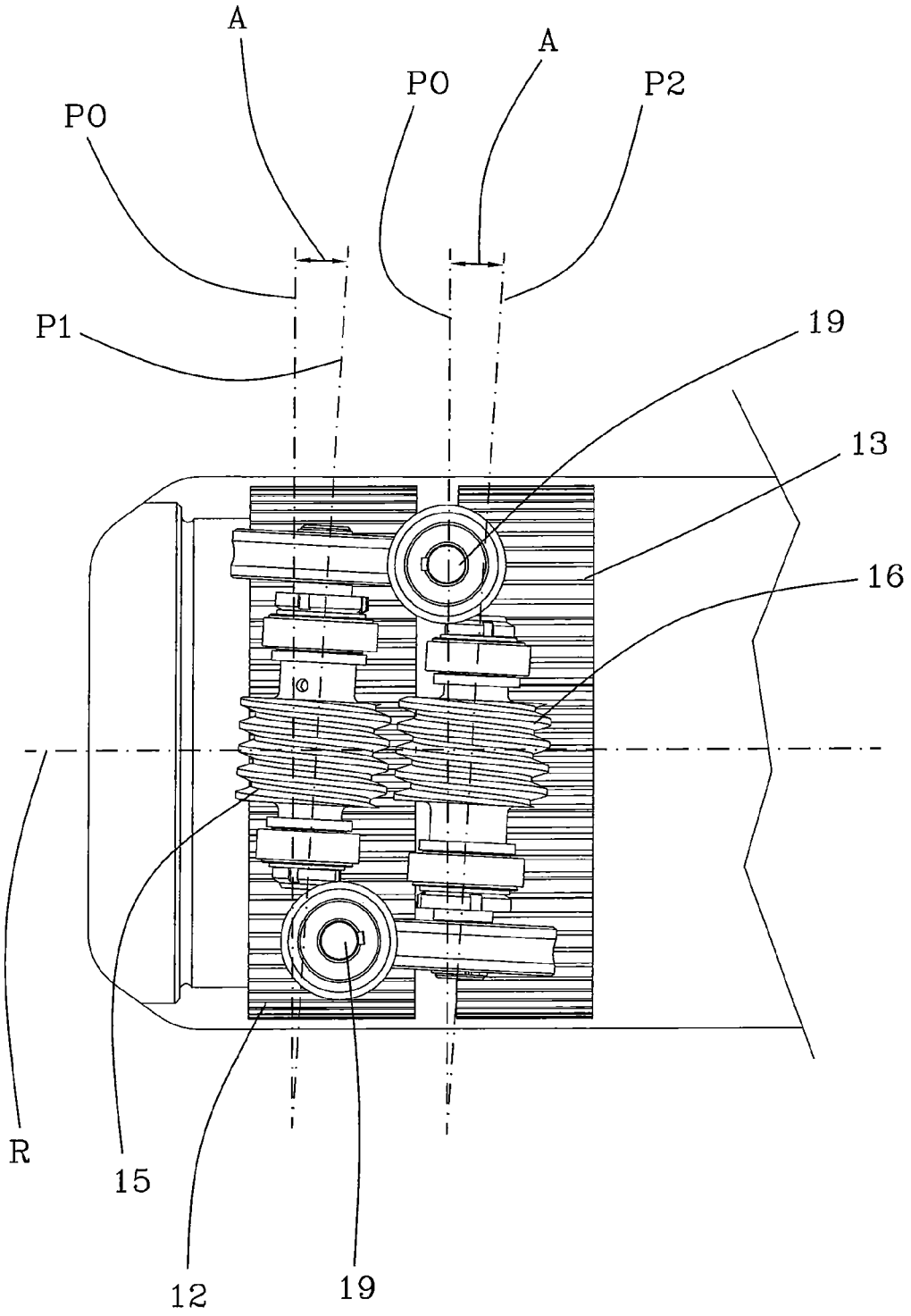
FIG. 5 is a detail view of the machine of FIG. 1 in a plan view.

The rotation axes P1, P2 of the worm wheels 15, 16 are parallel to one another (see FIGS. 4 and 5), they lie on a plane PG that is parallel to the flank lines L of the cylindrical gear wheels (see FIG. 4) and are inclined with respect to said flank lines (see FIGS. 4 and 5).

Figure 6:
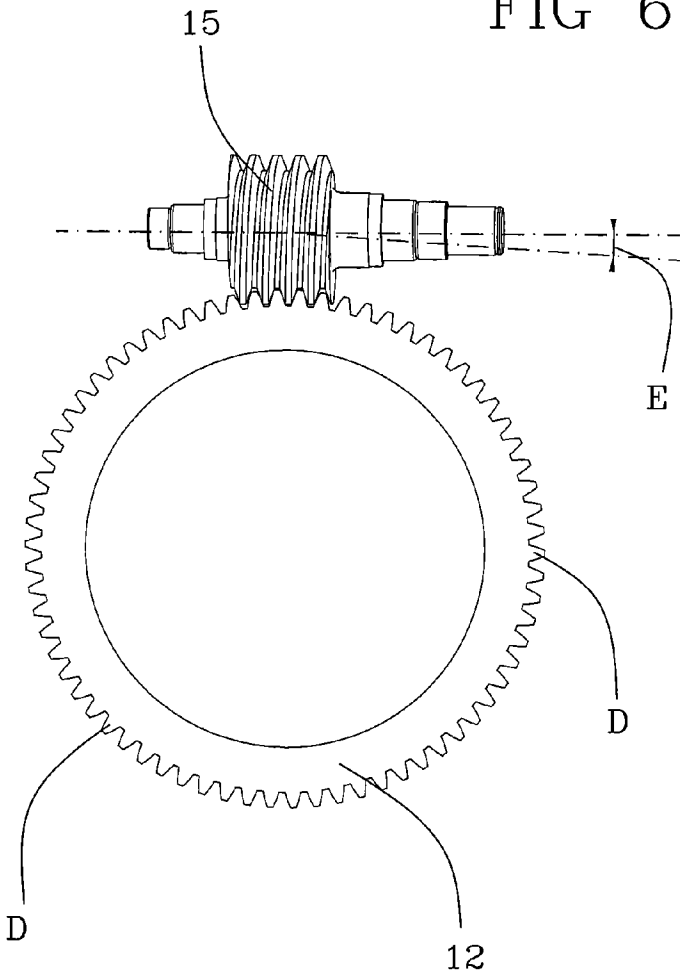
FIG. 6 is a front view of the detail of FIG. 4.

It should be noted that the helix angle E of the worm screws (FIG. 6) is constant on all helixes and it is equal to the angle A of inclination of the rotation axis P1, P2 of the worm screws with respect to the plane PO that is orthogonal to the rotation axis of the gear wheel 12, 13 (FIG. 5) coinciding with the development axis X of the cylinder 2.

Preferably, the angle E of inclination of the helixes is of between 1° and 15°.

It should be noted that in the area in which the gear wheel 12, 13 and worm screw 15, 16 (FIG. 6) engage, the development of the profile of the helix of the worm screw is substantially parallel to the flank line L of the tooth, allowing the gear wheel to be able to translate parallel to its own rotation axis without mechanically interfering with the worm screw.

As mentioned above, the first end 14*a* of the sleeve 14 acts on the first insulation chamber 4. In particular, the first insulation chamber 4 is defined by an annular groove inside the cylinder 2 defined on one side by the first end 14*a* of the sleeve 14 and on the opposite side by a shoulder which is fixed with respect to the cylinder 2. The volume of the first insulation chamber 4 can thus vary according to the position of the sleeve 14. As the volume of the first insulation chamber 4 decreases, the first set of gaskets 6 exerts a pressure that gradually increases between the cylinder 2 and piston 3. The greater the pressure exerted by the first set of gaskets 6, the greater the fluid seal between the cylinder 2 and the piston 3.

The second insulation chamber 5 is defined by an annular groove 14*c* of the sleeve 14 defined on one side by the tubular threaded portion 11 of the second gland 9 and on the opposite side by a shoulder that is fixed with respect to the sleeve 14 (shoulder which in the preferred embodiment of the invention is obtained on the sleeve itself). The tubular threaded portion 11 is engaged with the second end 14*b* of the sleeve 14 through a threading present on such a second end 14*b*. The volume of the second insulation chamber 5 can therefore vary as a function of the extent of screwing of the tubular threaded portion 11 of the second gland 9 in the second end 14*b* of the sleeve 14. As the volume of the second insulation chamber 5 decreases, the second set of gaskets 7 exerts a pressure that gradually increases between the sleeve 14 (and therefore the cylinder 2) and the piston 3. The greater the pressure exerted by the second set of gaskets 7, the greater the fluid seal between the cylinder 2 and the piston 3.

In order to increase and decrease the volume of the first insulation chamber 4 it is necessary to translate the sleeve 14 inside the cylinder 2. It should be noted that the sleeve 14 is fittingly inserted inside the cylinder 2, in other words the outer diameter of the sleeve 14 substantially coincides with the inner diameter of the cylinder 2 in the region on which the sleeve presses. The translation of the sleeve 14 is actuated by rotating the ring nut 12 of the first gland 8. The tubular threaded portion 10 of the latter is engaged on a threading 2*a* obtained on the outer surface of the cylinder 2 or on a surface that is fixedly attached to the cylinder 2. By rotating the ring nut 12, the tubular threaded portion 10 screws on (or unscrews) with respect to the cylinder 2, making the ring nut 12 translate closer to (or away from) the first insulation chamber 4. The rototranslation of the ring nut 12 causes the sleeve 14 to translate. It should be noted that the sleeve 14 and the ring nut 12 are fixedly connected to one another so that the ring nut 12 can freely rotate with respect to the sleeve 14 and cannot freely rotate with respect to it. In other words, a translation of the ring nut 12 causes a corresponding translation of the sleeve 14, whereas a translation of the ring nut 13 has no effect on the sleeve 14.

In order to increase and decrease the volume of the second insulation chamber 5 it is necessary to respectively decrease or increase how far the tubular threaded portion 11 of the second gland 9 is inserted in the threading of the second end 14*b* of the sleeve 14. Such an operation is carried out by rotating the ring nut 13 of the second gland 9. The tubular threaded portion 11 screws on (or unscrews) with respect to the sleeve 14, making the ring nut 13 translate towards (or away from) the second insulation chamber 5. The overall movement of the ring nut 13 is thus a rototranslation.

The first and the second insulation chamber obtain a double mechanical seal, that is to say they obtain two separate fluid seal areas between the piston and the cylinder.

Between these two areas there is an intermediate chamber 17 that is placed in fluid communication, for example through a recirculation circuit 18 (only partially shown in the figures), with a source of inert liquid. The intermediate chamber 17 has the function of allowing the pumped liquid to be diluted and removed by means of a dedicated pressurised circuit, preventing possible leakage of pumped liquid from reaching the atmosphere or the machine body.

The rotation of the ring nuts 12, 13 occurs through the cylindrical pinions 15, 16. Such pinions are set in motion by a respective torque multiplier 19 (FIG. 5) that is capable of reducing the number of revs and of increasing the torque applied to the cylindrical pinions 15, 16. Preferably, the torque multiplier receives power from an electric motor (not illustrated). Alternatively, the torque multiplier can receive power from a crank mechanism actuated by a user, for example in applications in which an electric energy source is not readily available.

In the light of what has been described above it is clear how it is possible to obtain an easy and immediate adjustment of the degree of sealing of the sets of gaskets in the insulation chambers.

Indeed, it is possible to act independently on both insulation chambers and in particular it is possible, for example, to loosen the pressure of the first set of gaskets in the first insulation chamber 4 while keeping the pressure of the second set of gaskets in the second insulation chamber 5 unaltered by translating the second chamber with respect to the cylinder without actuating the ring nut 13 of the second gland 9 while still keeping the ring nut 13 engaged on the respective pinion.

Figure 2:
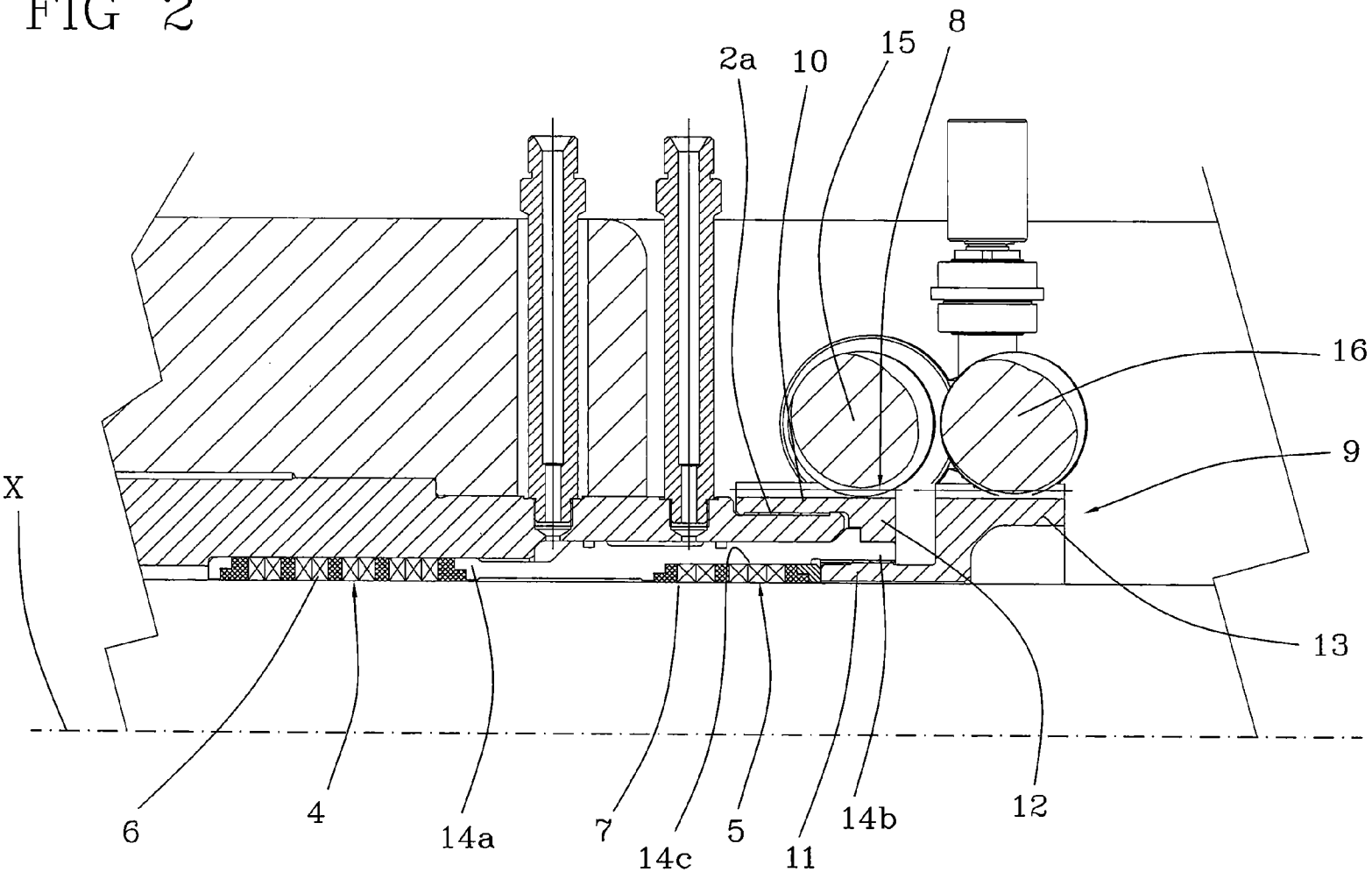
FIGS. 2 and 3 represent the machine of FIG. 1 in different operative positions of the glands.
Figure 3:
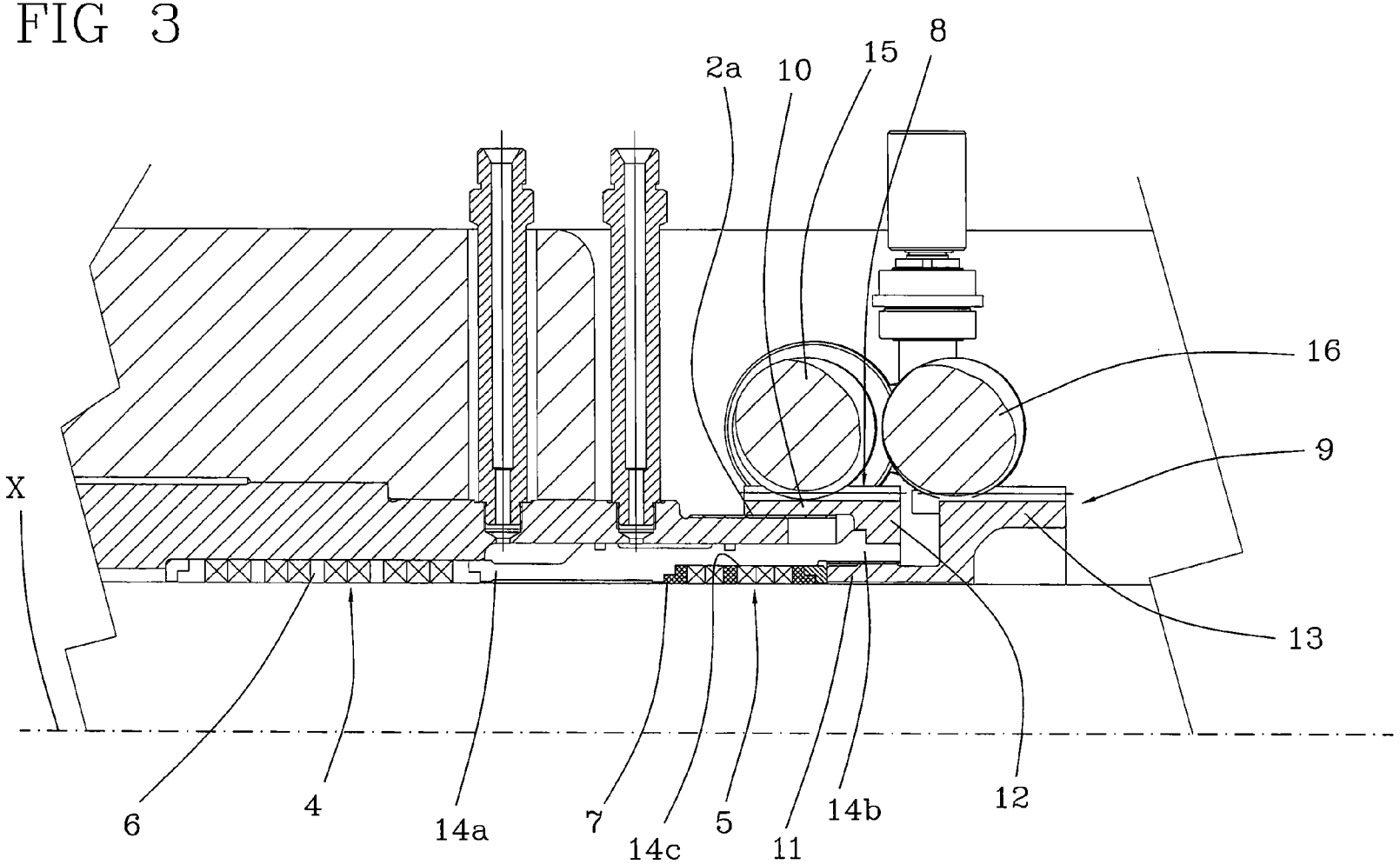

As an example, FIGS. 1 to 3 show what has been described above. In particular, FIGS. 1 to 3 show a sequence that makes it possible to decrease the pressure of the second set of gaskets and subsequently to decrease the pressure of the first set of gaskets whilst leaving the pressure of the second set of gaskets unaltered.

From the configuration of FIG. 1, the ring nut 13 of the second gland 9 is rotated (by the cylindrical pinion 16) so that the tubular threaded portion 11 decreases how far the second end 14*b* penetrates the sleeve 14. It should be noted that the overall movement of the ring nut 13 is a rototranslation. The volume of the second insulation chamber 5 increases decreasing the level of compression of the second set of gaskets 7 (FIG. 2).

At this stage (FIG. 3), the ring nut 12 of the first gland 8 is rotated by the cylindrical pinion 15 and the tubular threaded portion 10 is unscrewed with respect to the cylinder 2. It should be noted that the overall movement of the ring nut 12 is a rototranslation. The sleeve 14 follows the movement of the ring nut 12 increasing the volume of the first insulation chamber 4 with consequent loosening of the pressure exerted by the first set of gaskets.

Simultaneously, also the tubular threaded portion 11 of the first gland translates (fixedly attached to the sleeve 14) causing the translation of the ring nut 12. The volume of the second insulation chamber 5 remains unvaried (just like the pressure exerted by the second set of gaskets). It should be noted that the ring nut 13 of the second gland is a translation, which occurs without the teeth of the gear wheel 13 mechanically interfering with the pinion 16.

Of course, with the purpose of satisfying contingent and specific requirements, a man skilled in the art can bring numerous modifications and variants to the device according to the invention described above, all moreover covered in the scope of protection of the invention as defined in the following claims.

The invention claimed is:

1. Positive displacement machine comprising a cylinder inside which there are a mobile piston, suitable for pressurising a fluid, at least a first insulation chamber and a second insulation chamber arranged along the cylinder and containing a respective first or second set of gaskets, at least a first gland and a second gland each of which is suitable for operating on one of said sets of gaskets, each gland comprising a tubular threaded portion and a ring nut fixedly attached to said tubular threaded portion so as to set it in rotation, wherein the machine comprises a sleeve that can slide with respect to said cylinder having a first end in contact with the first set of gaskets and a second threaded end so as to receive in engagement the tubular threaded portion of the second gland, said sleeve being slidingly engaged by the first gland, and in that at least one of said ring nuts of the first or of the second gland is a cylindrical gear wheel with straight teeth, and wherein said tubular threaded portion of the first gland engages a threading formed on, or fixedly attached to, said cylinder.

2. Machine according to claim 1, wherein the flank lines of the cylindrical gear wheel are rectilinear, parallel to one another and parallel to the axis of the cylinder.

3. Machine according to claim 1 wherein both the ring nuts of the first and second glands are cylindrical gear wheels with straight teeth.

4. Machine according to claim 1, comprising a first and a second cylindrical pinion active on the ring nut of the first and of the second gland, respectively, so as to transmit motion to said ring nuts.

5. Machine according to claim 4, wherein at least one ring nut can translate along a direction that is parallel to the flank lines of the cylindrical gear wheel without mechanically interfering with the respective cylindrical pinion.

6. Machine according to claim 4 wherein the cylindrical gear wheel with straight teeth of the ring nut, when engaged by the respective cylindrical pinion, can translate with a rectilinear motion with respect to the cylindrical pinion along a direction parallel to the flank line of the cylindrical gear wheel with straight teeth.

7. Machine according to claim 4, wherein said cylindrical pinions are worm screws.

8. Machine according to claim 3, wherein the rotation axes of the worm wheels are parallel to one another, they lie on a plane parallel to flank lines of the cylindrical gear wheels and are inclined with respect to said flank lines.

9. Machine according to claim 1, wherein the second insulation chamber is defined by an annular groove of the sleeve partially engaged by the threaded tubular portion of the second gland.

10. Machine according to claim 1, wherein the first insulation chamber is defined by an annular groove of said cylinder engaged by the first end of said sleeve.

11. Machine according to claim 1, comprising an intermediate chamber positioned between the first and the second insulation chamber; said intermediate chamber being in fluid communication with a source of inert liquid.

12. Machine according to claim 1, comprising a torque multiplier kinematically coupled with said cylindrical pinions so as to reduce the number of revs and to increase the torque applied to said cylindrical pinions.

13. Positive displacement machine comprising a cylinder inside which there are a mobile piston, suitable for pressurising a fluid, at least a first insulation chamber and a second insulation chamber arranged along the cylinder and containing a respective first or second set of gaskets, at least a first gland and a second gland each of which is suitable for operating on one of said sets of gaskets, each gland comprising a tubular threaded portion and a ring nut fixedly attached to said tubular threaded portion so as to set it in rotation, wherein the machine comprises a sleeve that can slide with respect to said cylinder having a first end in contact with the first set of gaskets and a second threaded end so as to receive in engagement the tubular threaded portion of the second gland, said sleeve being slidingly engaged by the first gland, and in that at least one of said ring nuts of the first or of the second gland is a cylindrical gear wheel with straight teeth, and further comprising a torque multiplier kinematically coupled with said cylindrical pinions so as to reduce the number of revs and to increase the torque applied to said cylindrical pinions.

14. Machine according to claim 13, wherein the flank lines of the cylindrical gear wheel are rectilinear, parallel to one another and parallel to the axis of the cylinder.

15. Machine according to claim 13, wherein both the ring nuts of the first and second glands are cylindrical gear wheels with straight teeth.

16. Machine according to claim 13, comprising a first and a second cylindrical pinion active on the ring nut of the first and of the second gland, respectively, so as to transmit motion to said ring nuts.

17. Machine according to claim 13, wherein the second insulation chamber is defined by an annular groove of the sleeve partially engaged by the threaded tubular portion of the second gland.

18. Machine according to claim 13, wherein the first insulation chamber is defined by an annular groove of said cylinder engaged by the first end of said sleeve.

19. Machine according to claim 13, wherein said tubular threaded portion of the first gland engages a threading formed on, or fixedly attached to, said cylinder.

20. Machine according to claim 13, comprising an intermediate chamber positioned between the first and the second insulation chamber; said intermediate chamber being in fluid communication with a source of inert liquid.

* * * * *